United States Patent [19]

Schiemann

[11] Patent Number: 4,886,194

[45] Date of Patent: Dec. 12, 1989

[54] DISCHARGE TUBE

[76] Inventor: Wolfram Schiemann, Eugen-Nagele-Strasse 17, 7140 Ludwigsburg, Fed. Rep. of Germany

[21] Appl. No.: 173,089

[22] Filed: Mar. 25, 1988

[30] Foreign Application Priority Data

Jul. 31, 1987 [DE] Fed. Rep. of Germany ..... 3725389

[51] Int. Cl.[4] ..... B67D 3/00

[52] U.S. Cl. ..... 222/478; 222/568; 222/527

[58] Field of Search ..... 222/568, 567, 478, 527, 222/529, 488, 489; 141/300

[56] References Cited

U.S. PATENT DOCUMENTS 1,523,696 1/1925 Lewis ..... 222/568
4,426,027 1/1984 Maynard ..... 222/529
4,492,324 1/1985 Weber ..... 222/529
4,597,513 7/1986 Schiemann ..... 222/568

FOREIGN PATENT DOCUMENTS 2514278 10/1976 Fed. Rep. of Germany ..... 222/478

*Primary Examiner*—H. Grant Skaggs

[57] ABSTRACT

A plastic discharge tube for a fuel can has a canward tube section, a discharge section, a central section having flexible bellows-type peripheral grooves, and axially parallel depressions on the wall of the discharge tube that form a partition wall in the cross-section of the discharge tube. The partition wall is discontinued over the length of the central section provided with the bellows-type peripheral grooves, whereby the cross-section thereof is clear and circular.

12 Claims, 1 Drawing Sheet

(28) 29
(18) 19
10
11
12
13
14
15
16
17
18
19
21
22
23
24
25
26
27
28
29
31
32
33
34
35
36
W
α
β
γ
2
3

DISCHARGE TUBE

BACKGROUND OF THE INVENTION

The invention relates to a discharge tube for a fuel can.

A discharge tube of this kind is described in German Patent DE-PS 2,514,278. The tube cross section is divided by the partition wall so that separate channels are available for the fuel flowing out and the air stream flowing back into the can as a compensation, thus making pouring out easier. The bellows-type central section makes it possible to reach even unfavorably located filler pipes easily. In the known discharge tube, the partition wall is designed to extend through this central section as well, making it necessary to employ a special ploy. The peripheral grooves of one tube part have namely to be arranged offset by half the spacing of the peripheral grooves of the other tube part to enable this groove arrangement to extend over the entire periphery right into the pinch-off seam. It goes without saying that the mold required to produce this discharge tube is correspondingly complicated and expensive. As is known, when a rod bends, said rod has what is called a neutral axis, which retains its length while the material on one side of it is compressed and that on the other side is stretched. In the flexible central section of the known discharge tube, however, this neutral axis cannot establish itself freely from the equilibrium of forces in the material but is forcibly established by the partition wall because this partition wall acts like a film hinge. However, this partition wall is situated in a plane which is laterally offset with respect to the central axis of the tube because the tube cross-section provided for the fuel has to be bigger than that for the returning air. As a result, the forcibly established neutral axis of the flexible central section is not where it would naturally be located. When the known discharge tube is bent, the bellows-type wall regions on each side of the partition wall are therefore stressed in a non-uniform manner. It is also observed that bending is concentrated on a central third of the total length of the bellows-type central section, while the rest of the central section provided with peripheral grooves remains virtually unchanged. Flexibility is thus restricted. In other words, given a specified amount of bending, the material is more highly stressed at some points, thereby jeopardizing its durability.

OBJECT AND STATEMENT OF THE INVENTION

It is an object of the invention to provide a discharge tube of the generic type which is simpler to produce and more reliable with respect to durability.

This object is achieved by the following features: A walled discharge tube of plastic has:

a canward tube section, a discharge section for introducing into a vehicle filler pipe, a central section having bellows-type peripheral grooves that are made flexible by means of the bellows-type peripheral grooves, and axially parallel depressions on the wall of the discharge tube that form a partition wall in the cross-section of the discharge tube, the partition wall being discontinued over the length of the central section provided with the bellows-type peripheral grooves, whereby the cross-section thereof is clear and circular.

Since there is no partition wall in the central section which is subjected to stress during bending and the cross section is circular, this central section unfailingly bends in accordance with the natural balance of forces in the bellows-type tube wall and is therefore stressed in a uniform manner. In accordance with the natural distribution of forces, the bending is also distributed in a substantially uniform manner over the entire length of the central section, with the result that stress concentrations are avoided. Each individual fold segment is deformed by a fraction of the bend and can therefore be bent backwards and forwards relatively frequently without breaking or tearing. The discharge tube therefore retains the tightness necessary to its functioning in the stressed central section, even after frequent changes in stress. In the central section, the liquid flowing out and the air flowing back are not separated and yet this does not prove to be a disadvantage. For in the two end regions, the separation brings about adequate stabilization of the liquid or air stream, in addition smoothing the turbulence in the central section after the manner of a suction or nozzle effect. Nor should one imagine that a continuous partition wall, such as that in the known device, would always keep air and liquid sharply separate. For in the majority of cases, the ever-so-carefully separated tube regions open into a single opening in the can, with the result that the liquid exiting at that point often also flows into both tube regions. Accordingly, in this system too, the air for pressure equalization usually flows back into the can against the stream of liquid in both tube regions. Particularly in the narrower cross section, the flow of air is thereby very much retarded. In the discharge tube according to the invention, the liquid entering the "incorrect" tube region can change over to the "correct" tube region in the central section. It has therefore been found that an interruption in the partition wall results in practice in hardly any noteworthy disturbances of the outflow of liquid but offers the abovementioned production and stress-related advantages.

Further advantageous features described in the preferred embodiment are as follows:

In the discharge section, the parallel depressions comprise two depressions directed towards one another and connected inside the tube to form the partition wall, whereby a sector extending over an arc width of 240 degrees is separated from the rest of the tube cross-section by the two depressions.

Each of the depressions has a U-arc-shaped cross-section directed towards one another and mutually abutting with one another at the U-arcs, with U-arms extending parallel to one another, the depressions being connected at their mutually abutting U-arcs.

The U-arms have walls with a clear width between them of approximately 3 mm and a wall thickness of approximately 0.5 mm.

The discharge section has one end region extending over a length of approximately 7 cm to the end of the section and the discharge sections have an external diameter of 20 mm.

The discharge section has a 3 cm-long transitional section which merges into a cylindrical section 1.5 cm in length and approximately 29 mm in external diameter, to which the central section adjoins.

The central section provided with the bellows-type peripheral grooves has a length of 9 cm and an external diameter of approximately 32 mm, the bellows-type peripheral grooves being drawn in to a depth of 2 mm, and the central section has a clear cross-section measuring 27 mm at the narrowest points created by the bellows-type peripheral grooves.

In the canward tube section, the parallel depressions comprise two depressions that are directed towards one another and are connected inside the tube to form the partition wall whereby a sector having an arc width of approximately 180° degrees is separated from the rest of the tube cross-section.

Each of the two depressions is directed towards one another and has an approximately V-shaped cross-section and V-arms enclosing an acute angle of approximately 30 degrees with rounded V-tips at which a connection between the two depressions is effected.

The canward tube section has a length of 4 cm and an external diameter of approximately 29 mm. An approximately 2 cm-long fixing section provided with an internal thread is molded onto the canward tube section.

The discharge tube has a radial plane and a fixing section on the canward tube and is of symmetrical design with respect to the radial plane with the exception of the fixing section.

DESCRIPTION OF THE DRAWINGS

The invention is explained in greater detail below with reference to a preferred embodiment illustrated in the drawing, in which.

DESCRIPTION OF A PREFERRED EMBODIMENT

Figures 1, 2, 3:
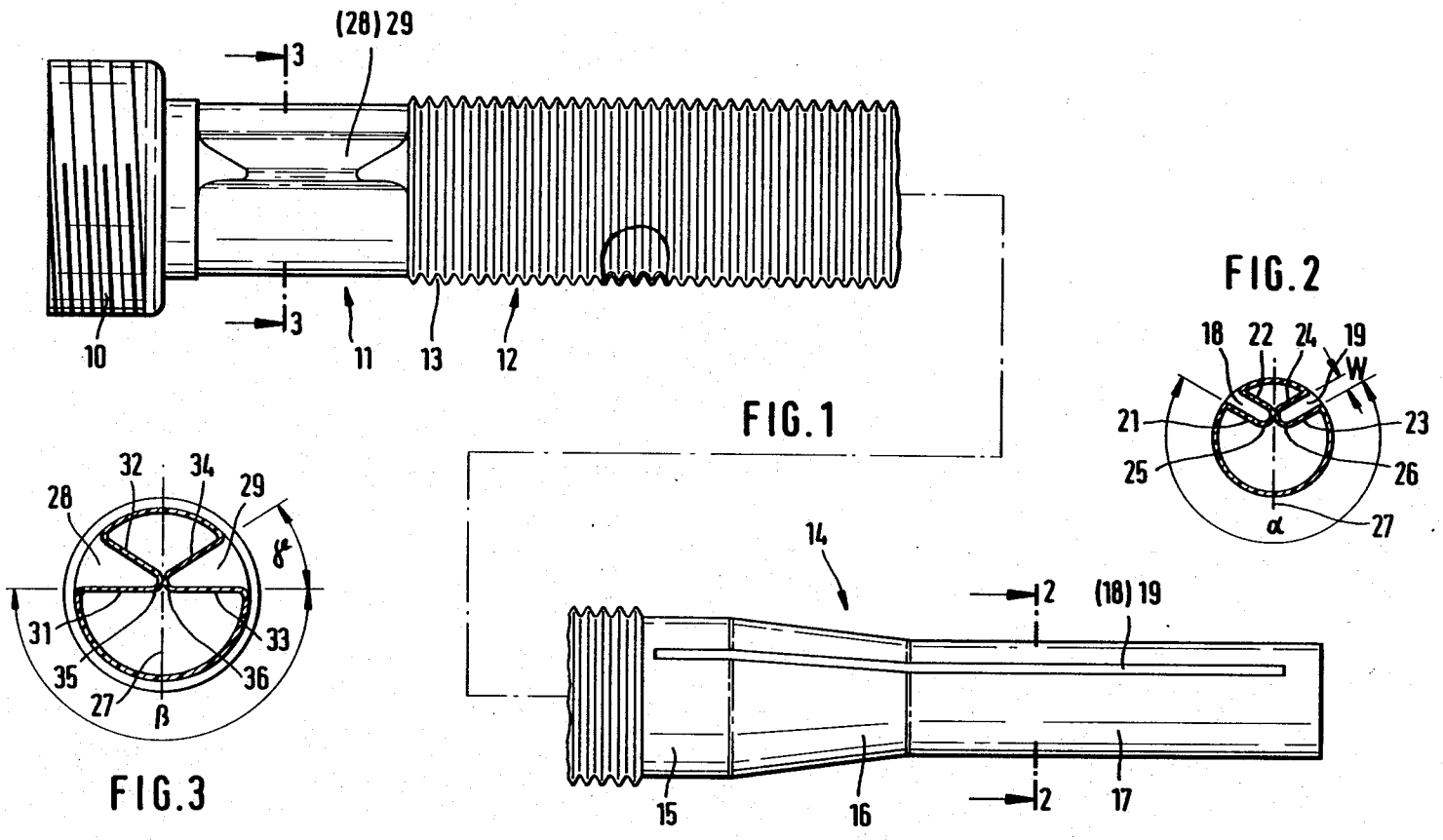
FIG. 1 shows a side elevation of a discharge tube according to the invention.
FIG. 2 shows a cross-section in the plane 2—2 of FIG. 1.
FIG. 3 shows a cross-section in the plane 3—3 of FIG. 1.

For reasons of space, the illustration of the discharge tube in FIG. 1 is divided approximately in the middle. On the left-hand end of the drawing, a fixing section 10 is illustrated, having a length of approximately 2 cm and being provided with an internal thread which, in a known manner, matches the external thread on the discharge branch of a commercially available plastic can. This fixing section 10 is followed by a canward tube section 11 having a length of approximately 4 cm and an external diameter of approximately 29 mm. Adjoining the latter is a central section 12, which has approximately 25 peripheral grooves 13, which are drawn into the tube wall while maintaining their wall thickness and are distributed over a length of approximately 9 cm. The external diameter between the resulting peaks is 32 mm, the peripheral grooves 13 being drawn into a depth of approximately 2 mm, so that at a wall thickness of 0.5 mm, the clear cross-section of the tube measures 27 mm at the narrowest point. By means of these peripheral grooves 13, the central section 12 is provided with a bellows-type form, with the result that the discharge tube is flexible at this point. A discharge section 14 for introducing into a vehicle filler pipe adjoins the central section 12, as shown in the lower part of the picture. The discharge section 14 is divided into a cylindrical section 15, 1.5 cm in length and approximately 28 mm in external diameter, which immediately adjoins the central section 12 and is followed by a conical transitional section 16 which, at a length of 3 cm, merges into an approximately 7 cm-long cylindrical end region 17, which has an external diameter of 20 mm. The discharge section 14 is therefore designed such that it penetrates the tank flap fitted for reasons of safety in the filler pipe of vehicles with catalysts and fits into the reduced diameter. It is therefore possible with the discharge tube to refuel both old vehicles and those provided with a catalyst. The discharge tube is preferably produced from thermoplastic material. The fixing section may also take the form of a radially protruding annular collar, which is pressed against the discharge branch of the can by means of a union nut, which is then fitted loosely on the canward tube section 11.

As can be seen from FIG. 2, the tube blank is now provided with axially parallel depressions 18 and 19, which extend over the discharge section 14, are directed towards one another and in each case have a U-shaped cross-section, the U-arms 21, 22 and 23, 24 extending parallel to one another and the U-arcs 25, 26 abutting against one another and being fused to one another at the contact point. Together with parts of the U-arcs 25 and 26, the U-arms 21 and 23 in this way form a partition wall by means of which a sector extending over an arc width a of 240 degrees is separated from the tube cross-section. To achieve this, the two U-arms 21 and 23 thus extend radially, approximately towards the center of the tube cross-section. The clear width W between the U-arms 21 and 22 and 23 and 24, which have a wall thickness of 0.5 mm, measures approximately 3 mm. The tube cross-section is therefore divided into the abovementioned large sector and an upper, small segment. Within the limits of accuracy achievable by production technology, the two depressions 18 and 19 are of symmetrical design with respect to the radial plane 27. As the lower part of FIG. 1 shows, these depressions 18 and 19 extend axially parallel essentially over the entire discharge section 14.

As FIG. 3 shows, in the canward tube section 11, there are likewise two depressions 28 and 29 but these have a V-shaped cross-section. The V-arms 31, 32 and 33, 34 here enclose an acute angle y of approximately 30 degrees, their V-tips 35 and 36 being rounded with a radius of approximately 1.5 mm. Here, the V-arms 31 and 33 and parts of the V-tips 35 and 36 form a partition wall by means of which a sector having an arc width B of approximately 180 degrees is separated from the tube cross-section. At this point too, the tube cross-section is divided by means of the depressions 28 and 29 into the abovementioned larger sector and a smaller segment between the V-arms 32 and 34. These depressions 28, 29 too are of symmetrical design with respect to the radial plane 27. In the extended position of the discharge tube, the V-arm 32 is therefore at least approximately in alignment with the U-arm 22 shown in FIG. 2 and the V-arm 34 is in alignment with the U-arm 24. It goes without saying that here too the V-tips 35 and 36 are fused to one another along their line of contact. As FIG. 1 shows, the depressions 28 and 29 in the region of the canward tube section 11 extend over a length of only approximately 2 to 2.5 cm.

In the region of the central section 12, whose clear cross-section of tube is circular, there is no depression or partition wall or the like.

Unless stated otherwise, the discharge tube generally has a wall thickness of approximately 1 mm. In the use condition, the discharge tube has a total length of approximately 28 cm but as a result of the bellows-type central section 12 it can be compressed to a length of 24 cm, this representing an advantage in terms of space for packing and dispatch at the factory.

It is also possible to provide a single helical spiral groove instead of the individual grooves 13.

What is claimed is:

1. A flexible walled discharge tube of plastic for attaching to a fuel can having an air channel for facilitating liquid flow, comprising a first tube section, a second tube section for introducing into a vehicle filler pipe, a central tube section between said first and said second tube sections having bellows-type peripheral grooves that is made flexible by means of said bellows-type peripheral grooves, said central tube section being in a flexible, bent condition when said second tube section is introduced into said vehicle filler pipe, and axially parallel depressions on the wall of said discharge tube that form a partition wall in the cross-section of said discharge tube to partition said air channel of said discharge tube, said partition wall being discontinued over the length of said central tube section provided with said bellows-type peripheral grooves whereby the cross-section thereof is clear and circular.

2. A discharge tube as claimed in claim 1, wherein in said second tube section said parallel depressions comprise two depressions directed towards one another and connected inside said tube to form said partition wall, whereby a sector extending over an arc length of 240 degrees is separated from the rest of said tube cross-section by said two depressions.

3. A discharge tube as claimed in claim 2, wherein each of said depressions has a U-arc-shaped cross-section directed towards one another and mutually abutting with one another at said U-arcs, with U-arms extending parallel to one another, said depressions being connected at their mutually abutting U-arcs.

4. A discharge tube as claimed in claim 3, wherein said U-arms have walls with a clear width between them of approximately 3 mm and a wall thickness of approximately 0.5 mm.

5. A discharge tube as claimed in claim 1, wherein said second tube section has one end region extending over a length of approximately 7 cm to the end of said section and said discharge tube has an external diameter of 20 mm.

6. A discharge tube as claimed in claim 5, wherein said second tube section has a 3 cm-long transitional section which merges into a cylindrical section 1.5 cm in length and approximately 29 mm in external diameter, to which said central tube section adjoins.

7. A discharge tube as claimed in claim 1, wherein said central tube section provided with said bellows-type peripheral grooves has a length of 9 cm and an external diameter of approximately 32 mm, said bellows-type peripheral grooves being drawn in to a depth of 2 mm, and said central tube section has a clear cross-section measuring 27 mm at the narrowest points created by said bellows-type peripheral grooves.

8. A discharge tube as claimed in claim 1, wherein in said first tube section said parallel depressions comprise two depressions that are directed towards one another and are connected inside the tube to form said partition wall whereby a sector having an arc width of approximately 180 degrees is separated from the rest of said tube cross-section.

9. A discharge tube as claimed in claim 8, wherein each of said two depressions is directed towards one another and has an approximately V-shaped cross-section and V-arms enclosing an acute angle of approximately 30 degrees with rounded V-tips at which a connection between said two depressions is effected.

10. A discharge tube as claimed in claim 8, wherein said first tube section has a length of 4 cm and an external diameter of approximately 29 mm.

11. A discharge tube as claimed in claim 1, wherein an approximately 2 cm-long fixing section provided with an internal thread is molded onto said first tube section.

12. A discharge tube as claimed in claim 1, wherein said discharge tube has a radial plane and a fixing section on said first tube section and said axially parallel depressions are symmetric with respect to said radial plane.

* * * * *